United States Patent [19]

Murray

[11] Patent Number: 4,937,718

[45] Date of Patent: Jun. 26, 1990

[54] DISCHARGE LAMP LUMINAIRE

[75] Inventor: Omer E. Murray, Hendersonville, N.C.

[73] Assignee: General Electric Company, Schenectady, N.Y.

[21] Appl. No.: 283,094

[22] Filed: Dec. 12, 1988

[51] Int. Cl.[5] ..... F21S 1/10

[52] U.S. Cl. ..... 362/431; 362/457; 362/368

[58] Field of Search ..... 362/457, 458, 431, 368; 361/377; 174/DIG. 2; 248/507, 510

[56] References Cited

U.S. PATENT DOCUMENTS

| | | | |
|---|---|---|---|
| 2,705,782 | 4/1955 | Boertzel | 248/507 |
| 4,358,816 | 11/1982 | Soileau | 362/346 |
| 4,426,676 | 1/1984 | Taylor | 362/371 |
| 4,434,456 | 2/1984 | Taylor | 362/374 |
| 4,639,843 | 1/1987 | Compton | 362/431 |
| 4,704,665 | 11/1987 | Grindle | 362/267 |
| 4,719,540 | 1/1988 | San George et al. | 174/DIG. 2 |
| 4,791,539 | 12/1988 | Ewing | 362/431 |

*Primary Examiner*—Ira S. Lazarus
*Assistant Examiner*—Sue Hagarman
*Attorney, Agent, or Firm*—John P. McMahon; Stanley C. Corwin; Fred Jacob

[57] ABSTRACT

A discharge lamp luminaire is disclosed having improved mounting means for electrical circuit components employed in the lamp ballasting circuitry. The improvement is attributable to a particular mounting bracket securing the electrical circuit component or components in place. A street lighting luminaire having such mount construction is also disclosed.

20 Claims, 2 Drawing Sheets

DISCHARGE LAMP LUMINAIRE

BACKGROUND OF THE INVENTION

This invention relates generally to a structural means for mounting ballast circuit components in luminaires utilizing discharge lamps and more particularly to such mount construction for sealed circuit components thereof.

Various type luminaires utilizing discharge lamps are known which generally comprise a housing containing a power module supporting ballast components and an optics compartment which includes a socket member for the lamp. Representative luminaires for use in various outdoor lighting applications are disclosed in U.S. Pat. Nos. 4,358,816; 4,426,676; and 4,434,456 all assigned to the assignee of the present invention. A commonly employed luminaire of this type for street and roadway lighting is described in the 4,426,676 patent which comprises an upper housing, whose underside is closed at the front end by a refractor supported in a frame member and at the rear by a hinged door. The ballast assembly for said luminaire construction is generally mounted on the door member for ease of installation and maintenance. A high intensity sodium vapor lamp, a mercury discharge lamp or a metal halide lamp commonly provides the illumination source in such luminaire construction having operatively associated lamp ballast means of the type disclosed in U.S. Pat. No. 4,472,015, also assigned to the present assignee. As therein illustrated with respect to a typical lamp ballasting circuit for use with a high intensity sodium vapor lamp embodiment, the ballast comprises a power module interconnected with a plug-in starting aid circuit and which can all be physically mounted in the luminaire construction as above indicated. The described power module embodiment includes a line power factor improvement capacitor while the starting aid circuit includes a second capacitor used in generating a series of high frequency pulses to initiate the arc discharge. It can be appreciated therefrom that capacitor devices are widely employed in lamp ballasting circuitry of many types as further indicated in said reference by the mention of still other ballast means for mercury discharge and metal halide discharge lamps. Indoor luminaires having a generally similar assembly are also well known and which frequently employ the above mentioned mercury discharge, sodium discharge and metal halide discharge lamps. Accordingly, the lamp ballasting means employed in said indoor luminaires is of the same type employed for outdoor luminaires and within the selected ballast circuitry also being housed entirely with the luminaire enclosure. A representative indoor luminaire adapted for exposure to severe weathering conditions or extremely corrosive atmospheres experienced in various industrial environments is disclosed in still further commonly assigned U.S. Pat. No. 4,704,665 and which can employ all of the aforementioned discharge lamps to provide the source of illumination.

Various attempts have been made to reduce the cost and complexity of mounting the circuit components for a ballast assembly in a discharge lamp luminaire. For example, the more than 50 different capacitors commonly employed in ballast circuits have different shapes and overall dimensions so that a large number of mounting brackets have become necessary and to further include many multipart bracket constructions. Additionally, it is often desirable to mount ballast circuit components in a vertical spatial orientation with respect to the mounting surface as distinct from the horizontal mount orientation now frequently employed in order to save space on the selected mounting substrate as well as provide easy access to the terminal connections. A ballast assembly mounted upon a substantially horizontal mounting surface would meet these objectives by mounting the particular circuit components with the terminals upright in a vertically extending direction whereas a wall mounted luminaire having a back plate as the ballast mounting surface satisfies the same objectives with the ballast circuit component or components being mounted so as to extend in a substantially horizontal direction. The nature and extent of difficulties now being experienced in satisfying such objectives with representative capacitor devices is largely due to differences found in cross sectional size and shape of these devices as well as to length variation. The conventional capacitor device and still other circuit components or devices commonly employed in a discharge lamp ballast are housed in sealed containers having top and bottom portions connected by side portions with electrical terminal means being secured to said top portion. Both circular and oval cross section ballast circuit components are employed with manufacturing tolerances enabling reasonably close control of the cross-sectional dimensions to be provided but with far less consistent dimensions being provided on device length. Accordingly, the common practice has been to mount these devices on their side with respect to the mounting surface while understandably sacrificing some mounting space in doing so. The various past attempts to mount such ballast circuit devices vertically with respect to the mounting surface have met with little success. For example, one prior art bracket includes a hooked end to physically engage the capacitor top portion and exert a downward force thereby requiring individual bracket lengths to satisfy capacitor length variation. Such mount construction further required retaining means to be added on the mounting surface to forestall lateral movement of the installed capacitor device. Significant costs can be associated with such mounting means upon considering the inventory of hooked brackets needed along with a possible further need to cast retainer means in the body of a metal or plastic luminaire housing. A different prior art capacitor mounting bracket frictionally engages the side portions of said device with a clamping arrangement. Again, excessive variation in the capacitor physical dimensions required an adhesive to forestall movement after assembly while the installation of such clamping arrangement also proved difficult. A still different prior art means to mount the illustrated capacitor device in a vertical spatial orientation employs an L shaped bracket secured to the capacitor side portions with a horizontal clamp. The assembly labor required to install such clamping means proved extensive with additional costs being experienced from injury or destruction of the capacitor devices due to excessive lateral compressive forces. A still different unsuccessful clamping arrangement to vertically mount the illustrated capacitor device again employs a horizontal clamp having overlapping tab fastening means formed in a Z shaped configuration which compressed to frictionally engage the clamp around the capacitor side portions. Such clamping means also proved expensive as well as provided only a flimsy mounting of the installed capacitor device.

Accordingly, one object of the present invention is to provide improved ballast circuit mounting means for use in a discharge lamp luminaire which is simpler to construct and easier to install.

A different object of the present invention is to provide a mounting means whereby a ballast circuit component or components can be physically secured to a mounting surface in a discharge lamp luminaire in various spatial orientations.

Still a different object of the present invention is to provide a discharge lamp luminaire having a ballast circuit component or components more rigidly mounted therein so as to be vertically positioned with respect to the mounting surface.

A still different object of the present invention is to provide mounting means for a ballast circuit component or components in a discharge lamp luminaire so as to be easily disengaged and reengaged by the customer, if desired, for repair or replacement of the component device.

These and still further objects of the present invention will become apparent upon considering the following detailed description for the present invention.

SUMMARY OF THE INVENTION

A novel structural configuration is now provided to physically mount a capacitor or other ballast circuit component or components in a discharge lamp luminaire whereby a single mounting bracket of relatively simple construction deforms when installed to exert a beneficial holding action upon the ballast circuitry joined thereto. More particularly, such improved ballast circuit component mounting means comprises in combination (a) at least one ballast circuit component housed in a sealed container having top and bottom portions connected by side portions, with electrical terminal means being secured to said top portion, (b) a mounting bracket to secure the container to a mounting surface in the discharge lamp luminaire so that its electrical terminals are upright with respect to the mounting surface, and (c) the mounting bracket having a deformable planar construction formed by a first planar section intersecting a second planar section, the first planar section being secured to the mounting surface so as to exert a mechanical spring force upon the second planar section in a downward direction with respect to the mounting surface, and the second planar section having a central opening physically engaging the container side portions at an angle. An opening can be provided in the first planar section of the present mounting bracket to enable its compression when joined to the mounting surface with conventional fastening means such as a machine screw or bolt. Such compression causes the bracket member to deform and provide a rotational action upon the container being held thereby desirably forcing the frictionally engaged container into the mounting surface. The central opening provided in the second planar section of the present bracket member to enable such coaction has the general shape of the particular container cross section being held but is desirably sized slightly larger to accommodate the deformation taking place as well as enable the bracket to be initially assembled to the container for joinder to the mounting surface. In a typical mounting configuration wherein a first assembled bracket and capacitor device are being fastened to a boss member extending vertically from the mounting surface, the size of the central opening provided in the second planar section and the angle of intersection between the first and second planar sections produces a tilted engagement with respect to mounting bracket and boss member until fastened together. When fastened together in such manner, frictional forces provided between the central opening in the deformed bracket member and the capacitor sides being gripped in said opening prevents further movement of the capacitor.

In general, a discharge lamp luminaire having such improved ballast circuit mounting means comprises in combination (a) a housing member defining a central closed cavity which houses a refractor, a discharge lamp and a ballast assembly residing in the central cavity, (b) the ballast assembly including at least one ballast circuit component housed within a sealed container physically secured to a mounting surface within said central cavity, (c) the sealed container having top and bottom portions connected by side portions, with electrical terminal means being included in said top portion, (d) a mounting bracket to secure the sealed container to said mounting surface so that its electrical terminals are upright with respect to the mounting surface, and (e) the mounting bracket having a deformable planar construction formed by a first planar section intersecting a second planar section, the first planar section being secured to the mounting surface so as to exert a mechanical spring force upon the second planar surface in a downward direction with respect to the mounting surface, and the second planar section having a central opening physically engaging the container side portions at an angle. A suitable luminaire construction having the above defined general configuration can understandably employ various housing shapes as well as various materials to form such structures including metals, ceramics and plastics. Accordingly, all of the above mentioned commonly assigned prior art patents are specifically incorporated herein by reference since all such luminaire constructions can be improved according to the present invention. Likewise, it is further contemplated that a suitable discharge lamp in the above generally defined luminaire construction can be selected from a wide variety of high intensity arc discharge lamps such as sodium vapor lamps, mercury vapor lamps and metal halide lamps, with such lamp selection further dictating the particular ballast assembly to be operatively associated therewith.

Generally, in one form of the present invention, a representative street lighting luminaire is provided comprising in combination (a) a luminaire member including an upper housing member whose underside is closed at the front by a refractor supported in the frame member, and at the rear by a door, the luminaire further including a high intensity discharge lamp, (b) the door having an interior horizontal mounting surface with a ballast assembly being secured thereto, (c) the ballast assembly having a lamp ballasting circuit which includes an electrical capacitor of the type providing power factor correction, (d) the electrical capacitor being housed in a sealed container having top and bottom portions connected by side portions, with electrical terminal means being included in said top portion, (e) a mounting bracket to secure the capacitor vertically in the luminance so that its electrical terminals are upright, and (f) the mounting bracket having a deformable planar construction formed by a first planar section intersecting a second planar section at some angle, the first planar section being secured to the mounting surface so as to exert a mechanical spring force upon the second planar section in a downward direction, and the second planar section having a central opening physically engaging the capacitor side portions at a downward angle. In one embodiment, such representative luminaire construction employs a high pressure sodium vapor discharge lamp together with a ballast assembly which includes the type starting aid circuit means disclosed in the aforementioned 4,472,015 patent. As further therein disclosed, a metal halide discharge lamp along with a different ballasting circuit means can also be employed in the present representative luminaire construction. It is further contemplated in the practice of the present invention, therefore, to house all or portions of such starting aid circuit in a sealed container which is physically secured to a mounting surface in the luminaire with the same type mounting bracket.

DETAILED DESCRIPTION OF THE PREFERRED EMBODIMENTS

Figure 1:
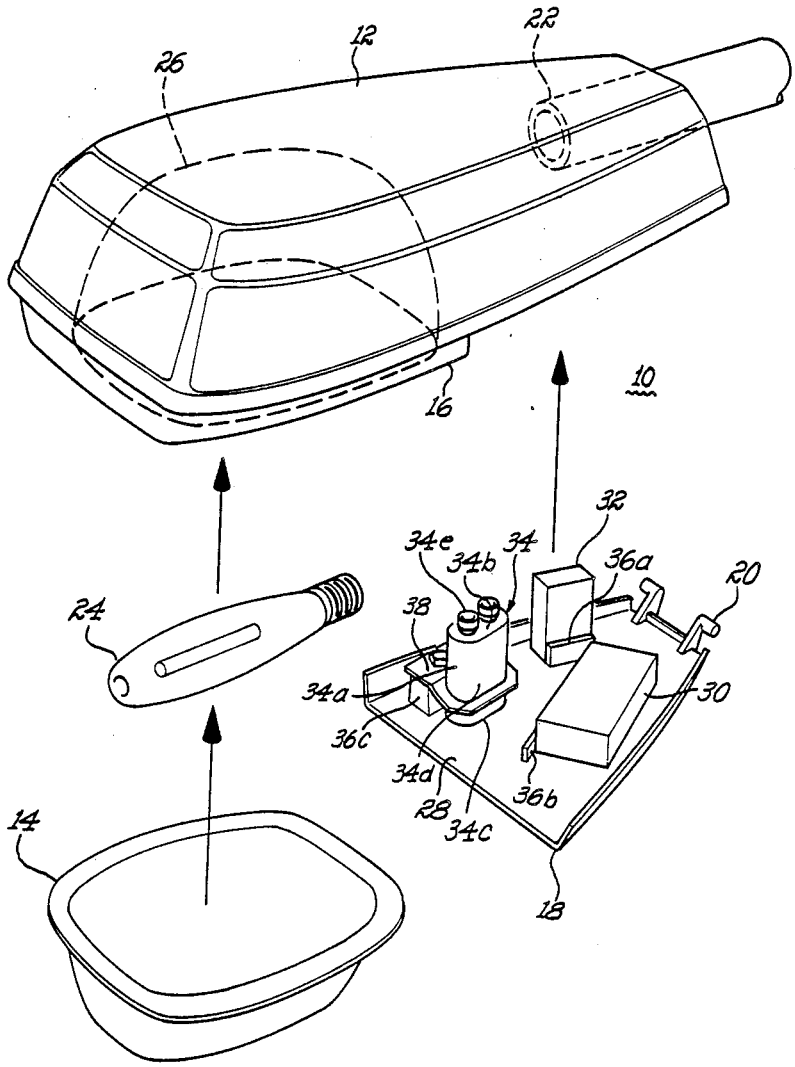
FIG. 1 is a perspective view depicting a representative luminaire construction in exploded relationship which employs capacitor mounting means according to the present invention.

Referring to the drawings, there is depicted in FIG. 1 a representative luminaire construction 10 according to the present invention which has a general structural configuration disclosed in the aforementioned 4,426,676 and 4,434,456 patents. Accordingly, such street lighting luminaire 10 is shown in an unassembled exploded arrangement so as to better illustrate the otherwise internal mounting means being employed for its ballast components. Luminaire 10 comprises an upper housing 12 whose underside is closed at the front by a refractor 14 when joined to a frame member 16 and at the rear by a hinged door 18. A door hinge 20 at the rear of the housing enables access to a central interior cavity (not shown) when the door is swung downwardly. Also only shown by phantom lines in the present drawing is the customary slipfitter construction 22 enabling said luminaire assembly to be secured to a light pole or some other means of physical support. The present luminaire embodiment 10 further includes a high intensity sodium vapor discharge lamp 24 providing the source of illumination when assembled to a concave reflector 26 physically held in this two part housing construction.

Door member 18 has a box-like structural configuration which includes an interior horizontal mounting surface 28 to which the ballast assembly components 30, 32 and 34 for discharge lamp 24 are physically secured. More particularly, the principal housing members in the illustrated luminaire construction to include door member 18, are formed with cast aluminum and with said door member having a plurality of boss members **36*a*, 36*b* and 36*c* provided on the interior mounting surface 28 when initially cast. Said boss members extend vertically from the mounting surface to provide anchoring sites whereby the individual ballasting components are physically secured as shown in the present drawing with conventional fastening means. The depicted ballasting components for the illustrated sodium vapor lamp 24 comprise reactor 30, a starting aid circuit 32 and electrical capacitor 34, all as more fully described in the aforementioned 4,472,015 patent. In accordance with the present invention, the illustrated capacitor 34 is housed in a sealed container 34*a* having top and bottom portions 34*b* and 34*c*, respectively, connected by side portions 34*d* and with electrical terminal means 34*e* being included in top portion 34*b*. Said electrical capacitor 34 is physically secured to mounting surface 28 so that its electrical terminals 34*e* are upright with respect to the mounting surface by employing a deformable mounting bracket 38 fastened to boss member 36*c*. As can be seen, the mounting bracket 38 is of a planar construction to be more fully described in FIGS. 2–3 below and physically grips the side portions 34*d*** of the electrical capacitor in a particular manner after having been fastened in place.

Figure 2:
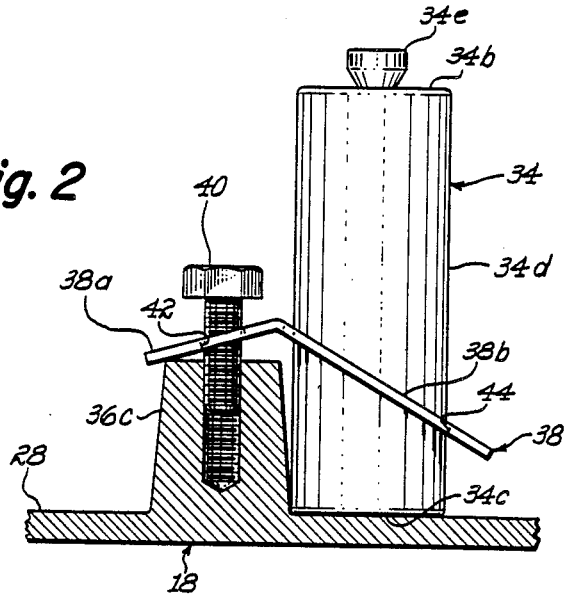
FIG. 2 is a side view partially in cross section which depicts initial assembly of the FIG. 1 mount means before being securely fastened to the mounting surface.

FIG. 2 is a side view partially in cross section depicting the improved capacitor mounting means employed in the FIG. 1 luminaire embodiment but before the bracket member 38 has been finally secured to the mounting surface. Specifically, said deformable mounting bracket is shown when only initially joined to capacitor 34 and prior to being deformed in the finally assembled arrangement. The illustrated mounting bracket can be seen to be formed with a first planar section **38*a* intersecting a second planar section 38*b* at an obtuse angle and with both planar sections further including joinder means enabling interconnection of capacitor 34 to its associated boss member 36*c*. Planar section 38*a* is physically secured to the top surface of boss member 36*c* with conventional fastening means 40 being inserted into an aperture opening 42 provided in said first planar section. Similarly, a central opening 44 provided in the second planar section 38*b* of said bracket member enables a loose fitting initial mating of capacitor 34 thereto. It should be further noted that the central opening 44 has a contour which generally corresponds to the cross sectional shape of capacitor 34 whereas the size of said opening and the angle of intersection between the first and second planar sections is predetermined so as to enable bracket deformation when finally fastened in place. The desired cooperation occurs in the illustrated mount construction with an upward tilted engagement between first planar section 38*a* and the top surface of boss member 36*c* when first assembled together and which produces a horizontal disposition therebetween when the fastening means 40** has been tightened in the final engagement.

Figure 3:
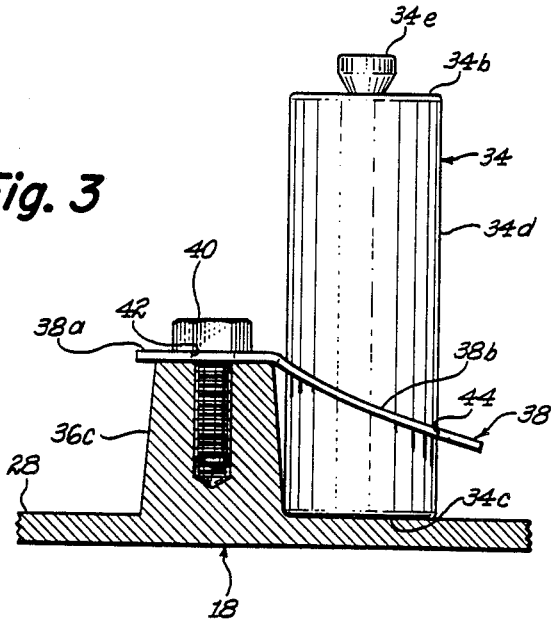
FIG. 3 is a side view depicting the finally secured mount construction of FIG. 2.

FIG. 3 is a side view depicting the finally assembled mount construction in FIG. 2 to still further explain the nature of physical forces involved which secure a capacitor to the mounting surface. Accordingly, the same numerals have been retained for identification of the respective structural elements and with the present drawing simply depicting these elements in the fully assembled arrangement. When the fastener 40 becomes tightened, there is a mechanical spring force generated in the second planar section **38*b* of the mounting bracket causing it to deform for physical engagement of its central opening 44 with the side portions 34*d* of the capacitor. As can be appreciated, the spring force is applied in a downward direction with respect to mounting surface 28 and which tends to rotate the capacitor 34 in a clockwise direction. Such clockwise rotation urges bottom portion 34*c* of the capacitor against the mounting surface while further desirably urging side portion 34*d* up against the retaining boss member 36*c*. Thus, as can be further appreciated, said spring force continues to be applied upon the capacitor member being secured to the mounting surface in such manner so that it remains firmly held in place under the influence of three cooperating gripping actions. While the depicted embodiment illustrates mounting of capacitor 34 on a horizontal mounting surface with its electrical terminals 34e** extending in an upright vertical direction, it also follows that the same beneficial gripping action would apply for a capacitor mounted on a vertical surface so that its terminals extend outwardly therefrom in a substantially horizontal direction.

It will be apparent from the foregoing description that a generally useful ballast circuit mounting means has been described for use in various discharge luminaire constructions. It will be understood, however, that the present improvement can be employed in various other luminaires constructed differently than above specifically described without departing from the spirit and scope of the present invention. For example, it is recognized that a wide variety of luminaire constructions have been developed for industrial lighting, hazardous location lighting, floodlighting, area lighting, roadway lighting and still other end product lighting applications along with various discharge lamps being utilized therein which employ various ballasting circuit means. Likewise, it has been shown that the disclosed mount construction proves useful with various electrical capacitor devices as well as still other ballast circuit components which are housed within a sealed container. Accordingly, it is intended to limit the present invention only by the scope of the following appended claims.

What I claim as new and desire to secure by Letters Patent of the United States is:

1. Improved ballast circuit mounting means for use in a discharge lamp luminaire comprising in combination:

(a) at least one ballast circuit component housed in a sealed container having top and bottom portions connected by side portions, with electrical terminal means being included in said top portion, (b) a mounting bracket to secure the container to a mounting surface in the discharge lamp luminaire so that its electrical terminals are upright with respect to the mounting surface, and (c) the mounting bracket having a deformable planar construction formed by a first planar section intersecting a second planar section, the first planar section being secured to the mounting surface by fastening means so as to exert a mechanical spring force upon the second planar section in a downward direction with respect to the mounting surface, and the second planar section having a central opening physically engaging the container side portions at an angle, whereby securing said fastening means to said mounting surface creates compression forces to cause said mounting bracket to deform and provide a rotational action upon said container which forces the container into said mounting surface so as to prevent movement between said container and mounting surface.

2. The mounting means of claim 1 wherein the ballast circuit component is an electrical capacitor device.

3. The mounting means of claim 1 wherein the mounting bracket is secured by said fastening means to a boss member extending from the mounting surface.

4. The mounting means of claim 3 wherein a fastener element projects through an opening provided in the first planar section of the mounting bracket.

5. The mounting means of claim 1 wherein the discharge lamp is a high intensity mercury discharge lamp.

6. The mounting means of claim 1 wherein the discharge lamp is a high intensity metal halide discharge lamp.

7. The mounting means of claim 1 wherein the discharge lamp is a high intensity sodium vapor discharge lamp.

8. The mounting means of claim 7 which further includes starting aid circuit means.

9. An improved structural configuration for a ballast assembly in a discharge lamp luminaire comprising in combination:

(a) a lamp ballasting circuit which includes at least one electrical circuit component being housed in a sealed container having top and bottom portions connected by side portions, with electrical terminal means being included in said top portion, (b) a mounting bracket to secure the container to a mounting surface in the discharge lamp luminaire so that its electrical terminals are upright with respect to the mounting surface, and (c) the mounting bracket having a deformable planar construction formed by a first planar section intersecting a second planar section at an obtuse angle, the first planar section being secured to the mounting surface with fastening means so as to exert a mechanical spring force upon the second planar section in a downward direction with respect to the mounting surface, and the second planar section having a central opening physically engaging the container side portions at an angle, whereby securing said fastening means to said mounting surface creates compression forces to cause said mounting bracket to deform and provide a rotational action upon said container which forces the container into said mounting surface so as to prevent movement between said container and mounting surface.

10. The structural configuration of claim 9 wherein the ballast circuit component is an electrical capacitor device.

11. The structural configuration of claim 9 wherein the discharge lamp is a high intensity sodium vapor discharge lamp.

12. The structural configuration of claim 11 which further includes starting aid circuit means.

13. A discharge lamp luminaire comprising in combination:

(a) a housing member defining a central closed cavity which houses a refractor, a discharge lamp and a ballast assembly residing in the central cavity, (b) the ballast assembly including at least one electrical circuit component being housed within a sealed container which is physically secured to a mounting surface within said central cavity, (c) the container having top and bottom portions connected by side portions, with electrical terminal means being included in said top portion, (d) a mounting bracket to secure the container to said mounting surface so that its electrical terminals are upright with respect to the mounting surface, and (e) the mounting bracket having a deformable planar construction formed by a first planar section intersecting a second planar section at an angle, the first planar section being secured to the mounting surface by fastening means so as to exert a mechanical spring force upon the second planar section in a downward direction with respect to the mounting surface, and the second planar section having a central opening physically engaging the container side portions at an angle, whereby securing said fastening means to said mounting surface creates compression forces to cause said mounting bracket to deform and provide a rotational action upon said container which forces the container into said mounting surface so as to prevent movement between said container and mounting surface.

14. The discharge lamp luminaire of claim 13 wherein the ballast circuit component is an electrical capacitor device.

15. The discharge lamp luminaire of claim 13 wherein the mounting bracket is secured to a boss member extending upwardly from the mounting surface with fastening means.

16. The discharge lamp luminaire of claim 13 wherein the discharge lamp is a high intensity arc discharge lamp selected from the group consisting of sodium vapor lamps, mercury vapor lamps and metal halide lamps.

17. A street lighting luminaire having an improved structural configuration comprising in combination:

(a) a luminaire member including an upper housing whose underside is closed at the front by a refractor supported in a frame member, and at the rear by a door, the luminaire further including a high intensity discharge lamp, (b) the door having an interior horizontal mounting surface with a ballast assembly being secured thereto, (c) the ballast assembly having a lamp ballasting circuit which includes an electrical capacitor of the type providing power factor correction, (d) the electrical capacitor being housed in a sealed container having top and bottom portions connected by side portions, with electrical terminal means being included in said top portion, (e) a mounting bracket to secure the capacitor vertically in the luminaire member so that its electrical terminals are upright, and (f) the mounting bracket having a deformable planar construction formed by a first planar section intersecting a second planar section at some angle, the first planar section being secured to the mounting surface by fastening means so as to exert a mechanical spring force upon the second planar section in a downward direction, the second planar section having a central opening physically engaging the capacitor side portions at a downward angle, whereby securing said fastening means to said mounting surface creates compression forces to cause said mounting bracket to deform and provide a rotational action upon said container which forces the container into said mounting surface so as to prevent movement between said container and mounting surface.

18. The street lighting luminaire of claim 17 wherein the mounting bracket is secured to a boss member extending upwardly from the horizontal mounting surface with fastening means.

19. The street lighting luminaire of claim 17 wherein the discharge lamp is a high intensity sodium vapor discharge lamp.

20. The street lighting luminaire of claim 17 which further includes starting aid circuit means being secured to the horizontal mounting surface.

* * * * *